United States Patent [19]

Tse

[11] 4,270,913

[45] Jun. 2, 1981

[54] PILL-RESISTANT POLYESTER FABRICS

[75] Inventor: Patrick S. Tse, Charlotte, N.C.

[73] Assignee: Celanese Corporation, New York, N.Y.

[21] Appl. No.: 55,244

[22] Filed: Jul. 6, 1979

[51] Int. Cl.[3] ..... D06M 5/02; D06M 3/04; D06M 3/12; D06M 5/10

[52] U.S. Cl. ..... 8/115.6; 8/115.5

[58] Field of Search ..... 8/115.5, 115.6

[56] References Cited

U.S. PATENT DOCUMENTS

| | | | |
|---|---|---|---|
| 2,828,528 | 4/1958 | Gajjar | 28/76 |
| 3,287,787 | 11/1966 | Goulding et al. | 28/76 |
| 3,834,868 | 9/1974 | Tatsuoka et al. | 8/130.1 |
| 4,008,044 | 2/1977 | Latta et al. | 8/115.5 |

FOREIGN PATENT DOCUMENTS 51-147698 12/1976 Japan .

OTHER PUBLICATIONS

"Caustic Treatment of Jersey Fabric Containing Terylene Staple Fibre", ICI Note#X75, pp. 9–10.

"Pilling Proofing of Polyester Based Textiles", NIRA (Dec. 12, 1976), 8590Y/05, (J51147698), Derwent Abstract.

"Antipilling Treatment for Knitted & Woven Polyester Fabric", NIRA (UNITIKAKK), Dec. 23, 1976, (J51150-000), 10270Y/06 Derwent Abs.

"Polyester Fabric Finishing with Metal Hydroxide Comp.", Derwent Abst. 82271W/50, (MITR) (J50065692), Jun. 3, 1975.

*Primary Examiner*—Joseph L. Schofer
*Assistant Examiner*—Herbert J. Lilling
*Attorney, Agent, or Firm*—Roderick B. Macleod

[57] ABSTRACT

Fabrics containing at least 50 percent by weight of polyester staple fiber have their pilling propensity greatly reduced by a process that involves (i) atomizing an aqueous solution of certain alkaline saponification agents, such as sodium hydroxide, (ii) applying the atomized solution in controlled amounts to at least one surface of the fabric, and (iii) heating the sprayed fabric to a temperature within the range of 115° C. to 165° C. for about 5 to 120 seconds.

20 Claims, 1 Drawing Figure

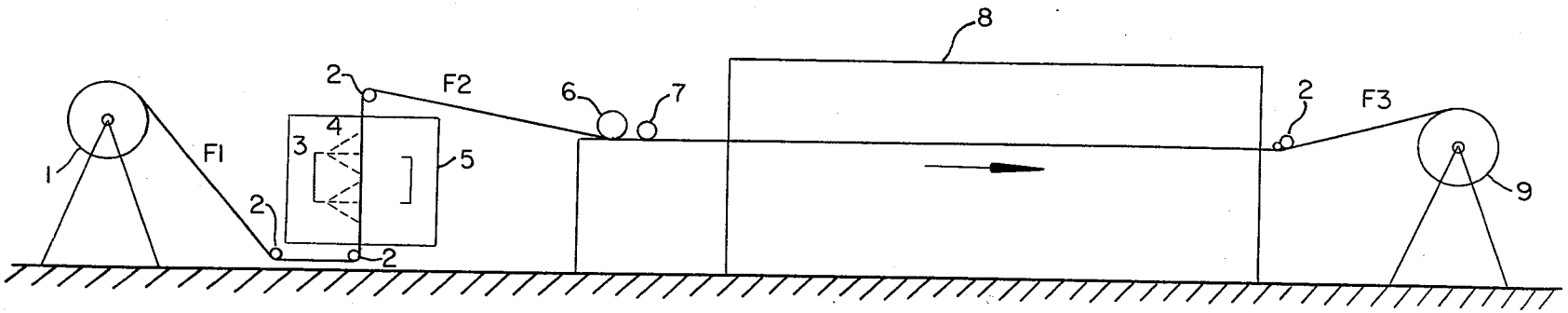
1
F1
2
3
4
5
2
2
F2
6
7
8
2
F3
9

PILL-RESISTANT POLYESTER FABRICS

BACKGROUND OF THE INVENTION (i) Field of the Invention

This invention relates generally to pill resistant polyester fabrics. More Particularly, it relates to an improved finishing process for reducing the pilling propensity of certain fabrics containing polyester staple fibers, which types of fabric are normally highly prone to pill (e.g., on account of the filaments having high tenacity and low denier per filament; or the fabric having loose weave or spaced loops, or employing single yarns). More specifically still, the field of the invention encompasses the spraying of fine particles of alkaline saponification agents onto the fabric's surface and thereafter heating the sprayed fabric.

(ii) Prior Art

The problem of "pilling " has been known to the textile industry for a long time. By it is understood the formation of small nodules as a result of rubbing or abraiding woven or knitted fabrics. Textile materials which are strongly prone to pilling often become unsightly even after short use.

Generally, two stages are involved in pilling:

(a) The gradual working up of fibers onto the surface of the material to produce a nap which then;

(b) Rolls together, tangles and felts to form nodules.

With wool or cellulosic fibers, these nodules are soon rubbed off during use because of the comparatively low strength of these fibers. However, the situation is more serious with the high-strength synthetic staple fibers, including standard polyester fibers. The reasons are as follows:

Their smooth surface and round cross-section favor the fibers working out of the material. The great tensile and flexing strengths, and also the abrasion resistance, of the polyester fibers are desirable from the point of view of good durability in wear, but they prevent a rapid tearing off, breaking or rubbing off of the nodules.

Materials containing only polyester staple fibers have a greater tendency to pilling than those mixtures of these fibers with either natural or regenerated fibers. With fabrics made of continuous filament polyester, the conditions for the formation of nodules are absent, since there are no fiber ends to protrude.

The textile manufacturer can often reduce the tendency to pilling by an appropriate selection of fibers and by taking special precautions during the manufacture of the yarn or fabric, for instance, by using polyester fiber having a long staple length; using a coarse count; imparting a pronounced crimp; employing a high twist in the yarn (or in doubling); employing doubled yarns instead of single yarns; weaving with short floats; and using a tight weave or close loops.

However, styling requirements frequently prevent sufficient use of the foregoing techniques to reduce pilling propensity. In such cases, resource has been made to various finishing techniques: in particular, heat-setting of the fabric or treating the fabric with synthetic resins such as silicic acid preparations (to reduce fiber mobility and migration); cropping and singeing (to remove the fiber ends that project out of the fabric); and treating with special chemicals to reduce the strength of the fibers.

Concerning treatment with special chemicals, it has been stated that: "by applying a carefully controlled treatment with certain chemicals during finishing, e.g., with 3-5% ammonia solution at 125°-130° C., the strength of the polyester fibers can be reduced to such an extent that the resulting fabrics have a low pilling tendency. The treatment can be applied to loose stock, slubbing, yarn or woven or knitted fabrics, depending on the form available and on the method of treatment chosen." However, such a process is not known to be in commercial use, perhaps on accounting of controlling the balance between excessive pilling and loss of fabric strength.

Also, U.S. Pat. No. 3,834,868 includes a detailed discussion of the prior art and describes an invention that is largely relevant to the present invention. In particular, the patent discloses a process in which fine particles of a treating agent containing certain acidic corrosive materials are sprayed onto the surface of the fabric to be treated and the fabric is thereafter heated, to corrode the fluffs on the surface of the fabric, thereby reducing the pilling propensity of the fabric.

While U.S. Pat. No. 3,834,868 itself is apparently silent concerning any use of alkaline saponification agents to reduce the pilling propensity of fabrics containing polyester staple fibers, some such art exists.

For example, I.C.I.'s U.S. Pat. No. 3,287,787 discloses the immersion of polyester fiber in solutions of caustic soda to preferentially stress corrode crimped polyester fiber at the crimp apexes. The patent teaches that the fiber should not have been heatset prior to treatment, and that with such fiber, treatment temperatures "below 110° C., preferably room temperature, up to about 70° C. are preferred" (see U.S. Pat. No. 3,287,787, column 4, line 17-25 and FIG. 3). I.C.I.'s publication "Caustic Treatment of Jersey Fabric Containing Terylene Staple Fibre" (May, 1974) includes the following:

"The basic treatment is 30 minutes in 2 g/l caustic flake at 60° C. It is important to note that such treatment must be carried out before heatsetting, otherwise its efficiency is greatly reduced. The two most convenient points at which to apply the caustic are during either scouring or reduction-clearing, the former usually giving slightly better pilling resistance.

"If applied during scouring, the soda ash component of the scouring bath is replaced by 2 g/l caustic flake, and if applied during reduction-clearing the ammonia component is replaced by 2 g/l caustic flake. Whichever technique is adopted, other conditions will remain unchanged (but see below).

"Increasing the caustic concentration above 2 g/l has no beneficial effect, nor does increasing the time beyond 30 minutes, where the maximum effect is obtained. The factor with the greatest effect on the efficiency of the treatment is temperature. Optimum improvement in pilling resistance is obtained by operating at 90°-100° C., but at this temperature a significant reduction in abrasion resistance is probable. High-temperature treatment should thus be used only with (a) fabrics that are very difficult to control for pilling or (b) those fabrics where very low abrasion levels are acceptable.

"The addition to the caustic scour or reduction-clearing bath of reagents, such as quaternary ammonium compounds, which accelerate caustic attack on polyester will improve pilling almost to total elimination, but the fabric will be completely unacceptable due to extreme loss of abrasion resistance. This procedure is therefore not recommended."

There has also been public use more than one year prior to the filing of this application, by applicant's assignee, of a process involving (i) padding of already dyed fabrics with solutions of 2 percent and 4 percent sodium hydroxide, plus an accelerator; and (ii) heat treating the product at temperatures of 350° F. for 20 seconds. The report concerning this public use concluded "The data attached show that 2% and 4% are better than no caustic and that 4% is worse than 2%." The process also involved singeing the product (to be salvaged by a customer) and even at 2% concentration the overall improvement in pilling propensity was only from 1-2 to 4, as measured by the Random Tumble Pilling Test (described below).

Sodium hydroxide has also been very extensively used in the processing of fabrics containing polyester fibers for purposes other than improving the pilling propensity. However, no art has been found relating to the treatment temperatures of fabrics containing polyester staple fibers in which the following combination of both high concentration of sodium hydroxide and high treatment were used: concentrations of at least 5 percent sodium hydroxide, and temperature of at least 115° C.

For example, U.S. Pat. No. 2,828,528 claims a process involving immersion of a polyester fabric in an aqueous solution of sodium hydroxide until the fabric has lost at least 5 percent in weight; and exemplifies the use of an aqueous solution containing 3% by weight sodium hydroxide at temperatures up to 100° C. The whole process results in a more silk-like product.

Also, U.S. Pat. No. 4,008,044 relates to a process for improving the soil release and wetting properties of a polyester textile material. The process involves, firstly, applying an aqueous solution containing up to 2.5 by weight of sodium hydroxide; and, secondly, then contacting the fabric with saturated steam for at least 10 minutes. This patent also includes a discussion of other prior art concerning the treatment of fabrics with aqueous solutions of sodium hydroxide.

It is also well known that mercerization of fabrics and the fixing of certain dyes involve the use of solutions of sodium hydroxide.

Accordingly, none of the foregoing prior art exemplifies anti-pilling treatment of a fabric containing polyester staple fibers which involves spraying the surface of a fabric with an aqueous solution containing at least 5 percent by weight of an alkaline saponification agent, and then heat treating the sprayed fabric at a temperature within the range 115° C. to 165° C. Further, there are teachings in the art that, individually, show high temperature is undesirable and that high concentration is undesirable.

SUMMARY OF THE INVENTION

In contrast to the forementioned prior art, it has now been surprisingly discovered that certain fabrics containing at least 50 percent by weight of polyester staple filaments may have their pilling propensity greatly reduced by a process that involves (i) atomizing an aqueous solution of certain alkaline saponification agents, such as sodium hyroxide, (ii) applying the atomized solution to at least one surface of the undyed fabric; and (iii) heating the sprayed fabric to a temperature within the range of 115° C. to 165° C. for about 5 to 120 seconds. The broadest aspect of the invention is more specifically defined in claim 1.

Further, the pilling propensity may be greatly reduced without the disadvantages of prior art processes being present. For example, there is no need to use swelling agents to treat effectively at temperatures in the range of 115° C. to 165° C., in contrast to the teachings of U.S. Pat. No. 3,834,868 concerning the use of acidic corrosive agents (e.g., see column 7, lines 3-23). Likewise, the process does not significantly increase the sheen of the fabric, in contrast to product disclosed by U.S. Pat. No. 3,834,868 (e.g., see column 8, lines 6-8 and Example 12). It is also preferred not to use an accelerator for the saponification reaction, in contrast to the teachings of U.S. Pat. No. 3,287,787 (e.g., claim 8 and FIG. 4 contrasted to FIG. 1). The concentration of sodium hydroxide is at least 5 percent by weight, in contrast to the preferable 2 percent disclosed in both the publicly used padding process and I.C.I.'s bulletin for treatment of jersey fabric. The particle size of the atomized particles may be up to about 130$\mu$, in contrast to the 110$\mu$, limit taught in U.S. Pat. No. 3,834,868 for acidic corrosive solutions. The period of heat treatment required appears to be lower than that needed for the acidic corrosive agents disclosed in U.S. Pat. No. 3,834,868. The process may be used on polyester/wool fabrics, in contrast to the teachings of the I.C.I. technical bulletin discussed above.

BRIEF DESCRIPTION OF THE DRAWING

FIG. 1 is a schematic diagram in side elevation of a process of the present invention.

DESCRIPTION OF THE PREFERRED EMBODIMENTS

The preferred embodiments of the invention are summarized in the claims below, hereby incorporated by reference.

In a typical process practising the invention, with reference to FIG. 1, untreated fabric (F1) is unwound from a conventional let-off roll (1); passes over guide rolls (2) and through a spray chamber (5) in which atomized particles (4) of an aqueous solution containing an alkaline saponification agent are sprayed from nozzles (3) onto the fabric (conventional means for feeding the nozzles is not shown). The sprayed fabric (F2) is then tentered conventionally by means of tentering brush (6), tentering roll (7) and other apparatus not shown, before the tentered, sprayed fabric is passed through a conventional heat treatment oven (8) at preselected speed and temperature. The heat treated fabric (F3) is then wound up on a conventional batcher or take-up roll (9), before the treated fabric is conventionally washed (by apparatus not shown).

The washed product (washed F3) is tested for pilling propensity by the Random Tumble Pillng Test (ASTM 3512); woven and nonwoven products (F1 and washed F3) are tested for Grab Strength (and therefore Grab Strength loss); knitted products (F1 and washed F3) are tested for Burst Strength (and therefore Burst Strength loss); and equal areas of F1 and washed F3 are weighed to determine the percent weight loss of the fabric during treatment. Sheen of the fabric may be observed visually.

It is preferred that the anti-pilling treatment be imparted to fabrics before dyeing, on account of the unacceptable speckled effect that may be obtained with certain dyestuffs when already dyed fabrics are treated.

While the invention has greatest utility in treating those types of fabric having constructions that make them highly prone to pilling, the use of the invention is not necessarily so limited.

Sodium hydroxide is the most preferred alkaline saponification agent used in the process, on account of its high effectiveness; high solubility in water at low temperatures; and low cost. However, sodium hydroxide, trisodium phosphate, tetrasodium pyrophosphate, sodium carbonate and sodium bicarbonate may also be used. Other alkalis have disadvantages including low effectiveness; tendency to clog spray nozzles; unpleasant fumes; low solubility at room temperature; and higher cost. Even with sodium hydroxide, however, it is preferable to have an enclosed spray chamber to protect the operators of the equipment, and to have appropriate guards to prevent the spray from getting on the tentering equipment.

It is preferred that the fabric be passed through the spray chamber with the fabric in an approximately vertical position and the spray nozzles spraying in an approximately horizontal direction. This reduces the chances of large drops of solution from an improperly functioning nozzle from falling onto the fabric. Large drops tend to penetrate the fabric and cause excessive local weakness within the main body of the fabric. The amount of spray actually applied may be measured by passing a portion of fabric of known weight through the spray chamber and measuring its increase in weight per unit area While numerous different types of spraying equipment may obviously be used, it is preferable to use an airless unit, i.e., a unit which does not mix air with the liquid to be atomized. The particle size of the particles emerging from the nozzles is determined from the conventional equipment manufacturer's calibration charts for the viscosity of the given liquid and air pressure that is used to operate the pumps that force the liquid through the nozzles.

The process results in some loss of fabric strength and weight. The percentage loss of fabric strength is generally a multiple of the percentage loss of fabric weight, and is typically within the range of 0 to 30%. In general, loss of fabric strength has not proved to be a problem, since the process permits the use of untreated polyester filaments having extremely high tenacity.

The staple fiber used in the process may be formed from any commercially known fiber forming polyester polymer. Particularly preferred is poly(ethylene terephthalate). The intensity of the anti-pilling treatment will naturally depend upon the ease with which the polymer can be saponified. Accordingly, the presence of reactive sulfonate groups in a poly(ethylene terephthalate) copolymer results in the possible use of less severe treatment conditions, such as less sodium hydroxide, higher speeds, lower dwell times, and lower temperatures.

The following Examples illustrate specific embodiments of the invention, but the invention is not limited to such Examples. The utility of the invention is demonstrated by the inclusion in the Examples of comparative data for fabrics prepared by identical processes except for the omission of the application of the spray of particles of aqueous solution of alkaline saponification agent.

EXAMPLES 1-27

Twenty-seven different fabric samples were prepared having the constructions and properties shown in Table 1 below. All the samples were prepared from various commercially available poly(ethylene terephthalate) staple fibers.

These samples were then processed under the conditions shown in Table 2 with the equipment shown schematically in FIG. 1 as described above, except that the spray was applied vertically downwards onto a fabric moving horizontally. The spray was applied by twelve Tex-Spray jets 650017, arranged in two rows of six across the width of the fabric and 32 inches above the fabric.

After being sprayed the fabric was tenter heat treated on a conventional Bruckner machine. The speed of the fabric was 10 yards/minute. The effective length of the oven was 10 yards. The period of heat treatment was 60 seconds. Dry heat at 160° C. was applied throughout the oven. Steam was used to indirectly heat the first half of the oven. The remainder was heated directly by gas. (Earlier experiments had shown that it was undesirable to heat the first half of the oven directly with gas. Lower pilling ratings were achieved. It is believed that the solution of sodium hydroxide reacted with the carbon dioxide in the gases forming the less effective sodium bicarbonate.)

All the treated products had markedly reduced pilling propensity as compared with the comparative untreated fabrics (see Table 3). None of the treated products had excessively high sheen. The treated and the untreated fabrics were then exhaust dyed. The dyed treated fabrics had a uniform color of the same shade as the dyed untreated fabrics.

TABLE 1

| | Untreated Fabric Properties | | | | |
|---|---|---|---|---|---|
| Ex. No. | Polyester Fiber Type | Tenacity gpd | DPF | Length Inches | Fabric Construction |
| 1 | Fortrel D-213 | 3.1 | 2.25 | 2 | Woven |
| 2 | Fortrel D-222 | 4.5 | 1.5 | 1.5 | Oxford |
| 3 | Dacron 107W | 4.5 | 1.5 | 1.5 | 40/1 cc × 15/1 cc |
| 4 | Fortrel T-310 | 5.8 | 1.5 | 1.5 | 3.75 TM |
| 5 | Trevira T-350 | 3.1 | 2.25 | 1.5 | |
| 6 | Fortrel D-213 | 3.1 | 2.25 | 2 | Woven |
| 7 | Fortrel D-222 | 4.5 | 1.5 | 1.5 | Printcloth |
| 8 | Dacron 107W | 4.5 | 1.5 | 1.5 | 35/1 cc × 35/1 cc |
| 9 | Fortrel T-310 | 5.8 | 1.5 | 1.5 | 3.75 TM |
| 10 | Trevira T-350 | 3.1 | 2.25 | 2 | |
| 11 | Fortrel D-213 | 3.1 | 2.25 | 2 | Woven |
| 12 | Fortrel D-222 | 4.5 | 1.5 | 1.5 | 2 × 1 twill |
| 13 | Dacron 107W | 4.5 | 1.5 | 1.5 | 14.5/1 cc × 14.5/1 cc |
| 14 | Fortrel T-310 | 5.8 | 1.5 | 1.5 | 4.0 TM |
| 15 | Trevira T-350 | 3.1 | 2.25 | 1.5 | |
| 16 | Fortrel D-213 | 3.1 | 2.25 | 1.5 | Knit |
| 17 | Fortrel D-222 | 4.5 | 1.5 | 1.5 | Jersey |
| 18 | Fortrel T-410 | 4.7 | 2.25 | 1.5 | 28 cut, 30/1 cc |
| 19 | Fortrel T-461 | 2.1 | 2.25 | 1.5 | 3.0 TM |
| 20 | Dacron 107W | 4.5 | 1.5 | 2 | |
| 21 | Trevira T-350 | 3.1 | 1.5 | 1.5 | |
| 22 | Fortrel D-213 | 3.1 | 2.25 | 1.5 | Knit |
| 23 | Fortrel D-222 | 4.5 | 1.5 | 1.5 | Swiss pique' |
| 24 | Fortrel T-410 | 4.7 | 2.25 | 1.5 | 28 cut, 30/1 cc |
| 25 | Fortrel T-461 | 2.1 | 2.25 | 1.5 | 3.0 TM |
| 26 | Dacron 107W | 4.5 | 1.5 | 2 | |
| 27 | Trevira T-350 | 3.1 | 1.5 | 1.5 | |

TABLE 2

| | Processing Conditions | | | | |
|---|---|---|---|---|---|
| Ex. No. | NaOH Conc. % | Spray Particle Size, μ | Deposition gm NaOH/M$^2$ | Temp, °C. | Dwell Time, Sec. |
| 1 | 7.5 | 115 to 130 | 3 | 160 | 60 |
| 2 | 7.5 | " | 3 | " | " |
| 3 | 7.5 | " | 3 | " | " |
| 4 | 10 | " | 4 | " | " |
| 5 | 7.5 | " | 3 | " | " |
| 6 | 7.5 | " | 3 | " | " |
| 7 | 7.5 | " | 3 | " | " |

TABLE 2-continued

| Ex. No. | NaOH Conc. % | Processing Conditions: Spray Particle Size, μ | Deposition gm NaOH/M² | Temp, °C. | Dwell Time, Sec. |
|---|---|---|---|---|---|
| 8 | 7.5 | " | 3 | " | " |
| 9 | 10 | " | 4 | " | " |
| 10 | 7.5 | " | 3 | " | " |
| 11 | 7.5 | " | 3 | " | " |
| 12 | 7.5 | " | 3 | " | " |
| 13 | 7.5 | " | 3 | " | " |
| 14 | 10 | " | 4 | " | " |
| 15 | 7.5 | " | 3 | " | " |
| 16 | 7.5 | " | 3 | " | " |
| 17 | 7.5 | " | 3 | " | " |
| 18 | 10 | " | 4 | " | " |
| 19 | 5 | " | 2 | " | " |
| 20 | 7.5 | " | 3 | " | " |
| 21 | 7.5 | " | 3 | " | " |
| 22 | 7.5 | " | 3 | " | " |
| 23 | 7.5 | " | 3 | " | " |
| 24 | 10 | " | 4 | " | " |
| 25 | 5 | " | 2 | " | " |
| 26 | 7.5 | " | 3 | " | " |
| 27 | 7.5 | " | 3 | " | " |

TABLE 3

Effect of Caustic Spray Treatment On Woven and Knit Fabrics

| Ex. No. | R.T. Pilling Rating: 20 | 30 | 60 | 20 | 30 | 60 | Loss, % | Loss*, % |
|---|---|---|---|---|---|---|---|---|
| 1 | 1 | 1 | 1 | 5 | 5 | 5 | 5.5 | 36 |
| 2 | 1 | 1 | 1 | 5 | 5 | 5 | 3.6 | 16 |
| 3 | 1 | 1 | 1 | 5 | 5 | 5 | 3.6 | 23 |
| 4 | 2 | 1 | 1 | 3.5 | 3 | 2.5 | 0 | 28 |
| 5 | 1 | 1 | 1 | 5 | 5 | 5 | 3.0 | 20 |
| 6 | 1.5 | 1 | 2 | 5 | 5 | 5 | 6.9 | 36 |
| 7 | 1 | 1 | 3 | 5 | 5 | 5 | 1.6 | 5 |
| 8 | 2 | 1.5 | 1 | 5 | 5 | 5 | 3.8 | 23 |
| 9 | 1 | 1 | 1 | 5 | 5 | 5 | 3.5 | 28 |
| 10 | 2 | 1.5 | 1 | 4.5 | 4.5 | 5 | 0 | 20 |
| 11 | 1.5 | 1 | 4.5 | 5 | 5 | 5 | 4.3 | 29 |
| 12 | 1 | 1 | 3.5 | 5 | 5 | 5 | 2.7 | 12 |
| 13 | 1 | 1 | 1 | 5 | 4.5 | 4 | 0 | 0 |
| 14 | 2 | 1 | 1 | 5 | 4.5 | 3.5 | 1.2 | 18 |
| 15 | 1 | 1 | 1 | 5 | 4.5 | 3 | 0 | 8 |
| 16 | 1.5 | 1.5 | 1.5 | 5 | 5 | 5 | 3 | 22 |
| 17 | 1 | 1 | 1 | 4.5 | 4.5 | 3.5 | 0 | 20 |
| 18 | 1 | 1 | 1 | 5 | 4.5 | 5 | 4 | 20 |
| 19 | 3.5 | 2 | 2 | 5 | 5 | 5 | 4 | 20 |
| 20 | 1 | 1 | 1 | 5 | 5 | 5 | 3 | 25 |
| 21 | 2 | 2 | 2 | 5 | 5 | 5 | 3 | 22 |
| 22 | 1 | 1 | 1 | 4.5 | 4.5 | 5 | 1.7 | 0 |
| 23 | 1 | 1 | 1 | 4.5 | 4.5 | 3.5 | 0 | 0 |
| 24 | 1.5 | 1 | 1 | 4.5 | 4.5 | 4.5 | 0 | 0 |
| 25 | 1 | 1 | 1 | 5 | 5 | 5 | 3.1 | 0 |
| 26 | 1 | 1 | 1 | 4.5 | 4.5 | 3.5 | 0 | 0 |
| 27 | 1 | 1 | 1 | 5 | 5 | 5 | 0 | 0 |

*Grab strength loss for woven fabrics by ASTM D 1682 burst strength loss for knit fabrics by ASTM D 231.

EXAMPLES 28–33

Four samples A-D of fabric were prepared as follows from blends of Fortrel, T-461, T-410, and D-213 having properties as shown in Table 1.

Fabric A: 75/25 T-461/T-410, 2×2 Twill.
Fabric B: 65/35 T-461/T-410, 2×2 Twill.
Fabric C: 65/35 D-213/T-410, 2×2 Twill.
Fabric D: 50/50 T-461/T-410, 2×2 Twill.

One set of samples was sprayed with 100 g/l sodium hydroxide solution to give a caustic solid add-on of 0.9 gm/yd² (Ex. 28–30). Another set of samples was sprayed with 200 g/l to give a caustic solid add-on of 1.8 g/yd² (Ex. 31–32).

Caustic spray solution was applied via the Tex-Spray unit with a 12-650017 jet at 80 psi. The samples were processed at 40 ypm, dried for 25 seconds at 120° C., 138° C. and 160° C. for each set of sprayed samples. Other conditions were as in Examples 1–27.

The sprayed and heat treated fabrics were conventionally washed for 10 minutes, conventionally dyed with Resolin Blue FBLD. The dyed fabrics were framed back to the finished width of 44 inches and tested for Random Tumble Pilling after 30 minutes and Grab Tensile Strength. The variable processing conditions and product properties are shown in Table 4 below. All untreated comparative fabrics had a pilling rating of 1.

TABLE 4

| Ex. No. | Treated Product Properties: Treated Fabric A Pilling 30 Min. | Treated Fabric A Grab, Lb. W × F | Treated Fabric B Pilling 30 Min. | Treated Fabric B Grab, Lb. W × F | Treated Fabric C Pilling 30 Min. | Treated Fabric C Grab, Lb. W × F | Treated Fabric C Pilling 30 Min. | Treated Fabric C Grab, Lb. W × F |
|---|---|---|---|---|---|---|---|---|
| 28 | 3–4 | 52 × 34 | 3 | 40 × 33 | 3 | 48 × 42 | 3–4 | 48 × 36 |
| 29 | 4 | 51 × 37 | 3 | 33 × 33 | 3–4 | 40 × 54 | 3–4 | 40 × 37 |
| 30 | 4 | 52 × 30 | 3–4 | 37 × 27 | 3 | 43 × 34 | 4 | 39 × 29 |
| 31 | 5 | 34 × 18 | 4–5 | 26 × 19 | 4 | 32 × 29 | 4–5 | 28 × 20 |
| 32 | 5 | 38 × 14 | 4–5 | 27 × 18 | 4–5 | 35 × 15 | 4–5 | 33 × 17 |
| 33 | — | — | 4–5 | 23 × 15 | 4 | 28 × 31 | 4 | 29 × 22 |

The excellent pill resistance performance was maintained after 21 home launderings. The treated samples showed wet and dry crock fastness at least as good as the untreated samples (AATCC 8).

EXAMPLE 34

A 65/35 polyester/cotton fabric was prepared from Fortrel T-310 (having a tenacity of 5.7 gm/denier; length of 1.5 inches; and denier of 1.5 dpf) and cotton. The fabric was a 2×1 twill having a weight of 158 gm/yd².

The fabric was predyed. The dyed fabric was sprayed with sodium hydroxide solution to give a solid deposit of 4 gm NaOH/yd². The sprayed fabric was heat treated for 25 seconds at 138° C. The treated fabric was found to have a pilling rating of 4.5, as compared with the untreated fabric whch had a pilling rating of 2. No significant shade change was observed in the treated fabric.

What I claim is:

1. An improved process for reducing the pilling propensity of a fabric comprising by weight at least 50 percent polyester staple fibers having tenacities in the range of about 2 to 6 gpd, deniers less than 3 d.p.f. and lengths of 2 inches and less, without significantly affecting either the grab strength of the fabric or the fabric dyeability or the absence of sheen in the fabric, comprising (a) atomizing an aqueous solution comprising at least 5 percent by weight of sodium hydroxide into a spray of fine particles having sizes up to 130μ; (b) applying said particles onto at least one surface of an undyed polyester fabric comprising by weight at least 50 percent polyester staple fibers having tenacities in the range of 2 to 6 gpd, deniers less than 3 d.p.f. and lengths of 2 inches and less, in an amount of said particles up to 40 cc per square meter of fabric; and, (c) applying heat to said sprayed fabric at a temperature within the range from about 115° C. to about 165° C. for a period of from about 10 seconds to about 90 seconds, to saponify, in part, said polyester fiber; wherein the improvement comprises:

applying a solid deposition of about 0.5 to 4 grams sodium hydroxide flakes (76% $Na_2O$) per square yard of fabric to said untreated polyester fibers having tenacities in the range of about 2 to 6 gpd, in the absence of a swelling agent;

and applying dry heat;

whereby said treated fabric has a pilling performance rating of at least 4 as measured by the Random Tumble Pilling Test (ASTM D 3512) after 30 minutes and after 60 minutes.

2. The process of claim 1 which comprises treating fabrics comprising cotton in an amount of up to 50 percent by weight of said fabric.

3. The process of claim 1 which comprises applying heat to said sprayed fabric at a temperature within the range 125° C. to 155° C.

4. The process of claim 3 which comprises applying heat to said sprayed fabric at a temperature within the range 135° C. to 145° C.

5. The process of claim 1 which comprises applying a solid deposition of about 0.5 to 3 grams sodium hydroxide flakes (76% $Na_2O$) per square yard of fabric, said untreated polyester fibers having tenacities in the range of about 2 to 3 gpd.

6. The process of claim 1 which comprises applying a solid deposition of about 2 to 4 grams sodium hydroxide flakes (76% $Na_2O$) per square yard of fabric, said untreated polyester staple fibers having tenacities in the range of about 3 to 4.5 gpd.

7. The process of claim 1 which comprises applying a solid deposition of about 3 to 6 grams sodium hydroxide flakes (76% $Na_2O$) per square yard of fabric, said untreated polyester fibers having tenacities in the range of about 4.5 to 6 gpd.

8. The process of claim 1 which comprises applying a solid deposition of 0.25 T to 1.5 T grams sodium hydroxide flakes (76% $Na_2O$) per square yard of fabric, where T is numerically equal to the average tenacity of said polyester staple fibers in said untreated fabric.

9. The process of claim 1 which comprises treating fabrics comprising wool in an amount up to 50 percent by weight of said fabric.

10. The process of claim 1 which comprises applying heat to said sprayed fabric for a period of from 20 to 50 seconds.

11. The process of claim 1 which comprises the absence of an accelerator for said alkaline saponification agent.

12. The process of claim 1 which comprises treating fabrics comprising acetate or triacetate staple fibers in an amount of up to 50 percent by weight of said fabric.

13. The process of claim 1 wherein said polyester is poly(ethylene terephthalate).

14. The process of claim 1 wherein said fabric comprises unplied yarns.

15. The process of claim 1 wherein said fabric is a woven fabric.

16. The process of claim 1 wherein said fabric is a knitted fabric.

17. The process of claim 1 wherein said fabric is a nonwoven fabric.

18. The process of claim 1 which comprises using an airless spray unit to atomize said aqueous solution.

19. The process of claim 18 wherein several overlapping airless spray units spray said particles approximately horizontally onto said fabric moving in approximately vertical direction, with a distance of 20 to 40 inches between said spray units and said fabric.

20. The process of claim 1 wherein said treated fabric has a pilling performance rating of 5.

* * * * *